United States Patent [19]

Kavoussi

[11] Patent Number: 4,625,402

[45] Date of Patent: Dec. 2, 1986

[54] AEROSOL SHAVING CREAM AND RAZOR

[76] Inventor: James P. Kavoussi, 1401 80th St., Brooklyn, N.Y. 11228

[21] Appl. No.: 726,038

[22] Filed: Apr. 22, 1985

[51] Int. Cl.[4] ..... B26B 21/44

[52] U.S. Cl. ..... 30/41; 30/90; 7/158; 7/168

[58] Field of Search ..... 30/41, 90; 7/158, 167, 7/168, 170

[56] References Cited

U.S. PATENT DOCUMENTS 1,319,669 10/1919 Muller ..... 30/41 X
1,677,954 7/1928 Cleary ..... 30/90 X
1,741,891 12/1929 Vallon ..... 30/41 X
1,950,769 3/1934 Baar ..... 30/41 X
4,023,269 5/1977 Lopez ..... 30/41

*Primary Examiner*—E. R. Kazenske
*Assistant Examiner*—Michael D. Folkerts
*Attorney, Agent, or Firm*—Richard L. Miller

[57] ABSTRACT

This invention is a shaving implement that includes a main body member attachable to a replaceable container of shaving cream, a brush mounted on the main body member for receiving shaving cream from the container, and a safety razor mounted on a yoke pivoted on the main body member.

3 Claims, 3 Drawing Figures

Fig.1
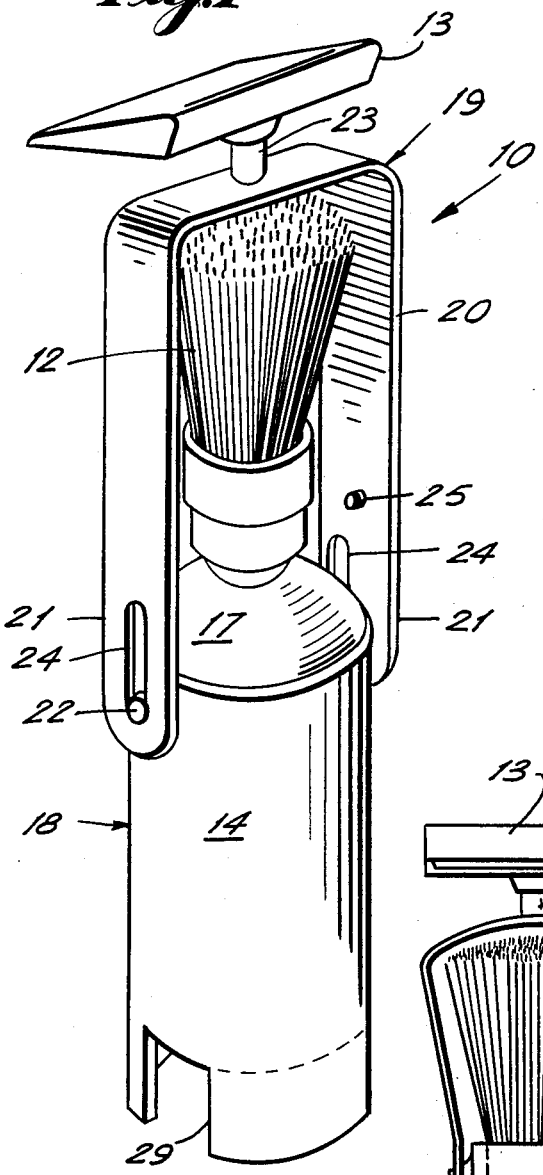
Fig.2
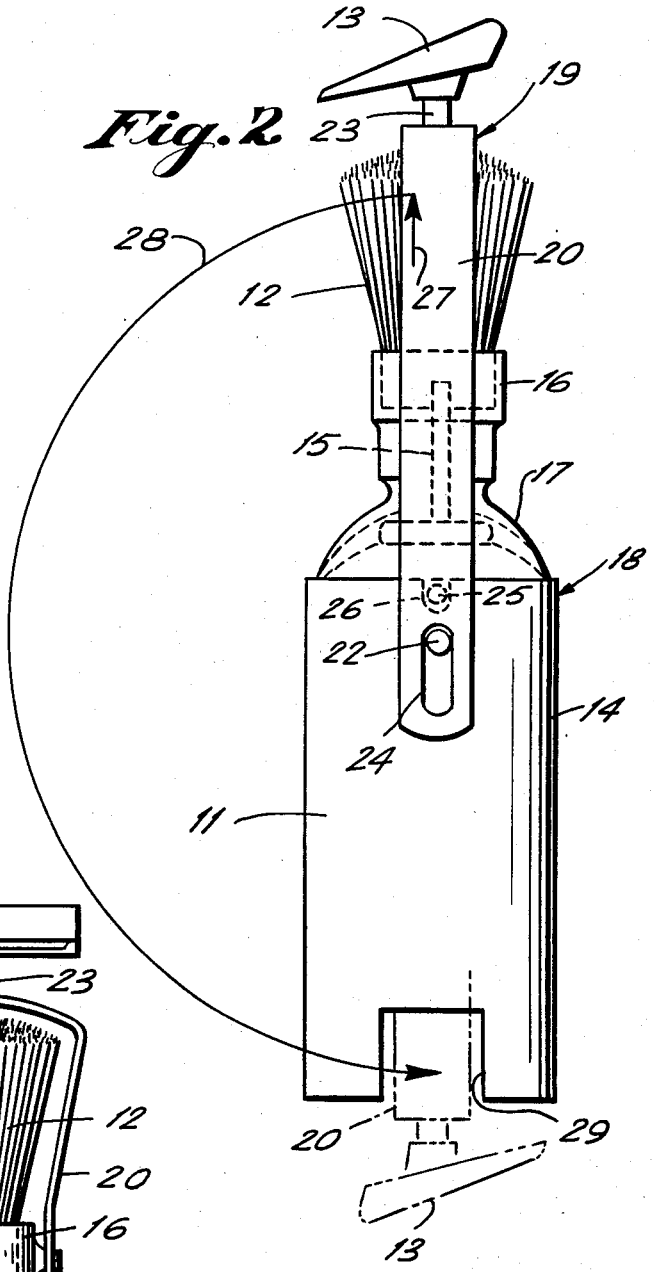
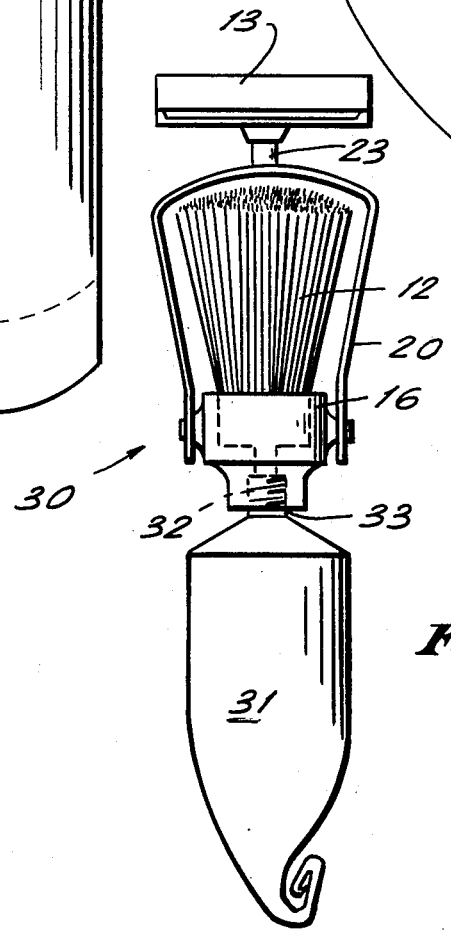
Fig.3

AEROSOL SHAVING CREAM AND RAZOR

BACKGROUND OF THE INVENTION

This invention relates generally to shaving implements such as are used for a cutting off of a growth of whiskers. More specifically it relates to holders of shaving cream used for softening whiskers prior to a shaving operation, a brush for applying the shaving cream of a face and a safety razor for then shaving a beard.

It is well known conventionally, a container of shaving cream, a brush and a safety razor are separate implements that are handled individually in sequence during a shaving operation, each of which must be picked up by a hand and then laid down afterwards so as to pick up a next one, all of which takes precious moments of time, particularly when a person is in a hurry such as when a man shaves in a morning and is rushing to go to work. This situation is accordingly in need of an improvement.

Therefore it is a principal object of the present invention to provide a combination implement that incorporates a container of shaving cream, a brush and a safety razor into a single unit for a quicker and more convenient handling while shaving.

Another object is to provide an aerosol shaving cream and razor which overcomes the situation of one of the articles being misplaced, dropped or scattered away from the others and thus delays a shaving procedure while looking for it.

Other objects are to provide an aerosol shaving cream and razor which is simple in design, inexpensive to manufacture, easy to use and efficient in operation.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCIPTION OF THE DRAWING FIGURES

The figures in the drawings are briefly described as follows:

FIG. 1 is a perspective view of the invention shown with a can of aerosol shaving cream installed therein.

FIG. 2 is a side view thereof.

FIG. 3 is a front view of a modified form of the invention shown designed for installation of a collapsible tube of shaving cream.

DETAILED DESCRIPTION OF THE PREFERRED EMBODIMENTS

Referring now to the Drawing in greater detail, and more particularly to FIGS. 1 and 2 thereof, at this time, the reference numeral 10 represents an aerosol shaving cream and razor according to the present invention wherein there is a container of shaving cream 11, a brush 12 and a safety razor 13 made up into a single unit. In this design, the shaving cream container comprises a pressurized aerosol can that is replaceable after its shaving cream is all exhausted. The can is slidably received through a lower opening of a sleeve 14 wherein it is functionally held. The dispensing nozzle 15 of the can protruding out of an opposite top end of the sleeve and into a hole of a brush holder 16 which when sidewardly depressed causes the dispensing action of shaving cream into a center of the shaving brush. The brush holder is formed on a top of a dome 17 formed on the top end of the sleeve, the dome enclosing the conventionally upwardly rounded end of the aerosol can. For most practical construction, the sleeve, dome and brush holder are molded into a one piece main body member 18 made of semi-rigid plastic material.

A razor unit 19 is pivotally mounted on the main body member and includes a rigid yoke 20 for bridging across a top of the brush. The ends of the yoke arms 21 pivoting on protrusions 22 formed on diametrically opposite sides of the sleeve. The conventional safety razor is rigidly mounted on the yoke by means of a stem 23.

In operative use, during a shaving operation, the yoke is pivoted out of a way initially so as to expose the brush for lathering a beard, while shaving cream is being dispensed from the can into the brush. Then the yoke is pivoted over a top of the brush as shown in FIG. 1 and is then downwardly depressed by sliding the protrusions in the slots 24 of the yoke and engaging buttons 25 of the yoke inside notches 26 of the sleeve in order to lock the yoke in the position shown in FIG. 2, and proceed to shave with the safety razor. After finishing the shave, the yoke is lifted as shown by arrow 27 so as to disengage the buttons and notches, and the yoke is then pivoted as shown by arrow 28 to the position shown in phantom lines. Then an upward push locks the yoke in the sleeve notches 29 for storing the device in a compact condition.

In a modified design 30 of the invention shown in FIG. 3, the device is made adaptable for attachment upon a conventional, replaceable, collapsible tube of shaving cream 31 by means of a threaded opening 32 on the brush holder for screwing on the threaded stem 33 normally used for a screw cap. In operative use, the collapsible tube serves as a brush handle and can be squeezed as needed to dispense the shaving cream to the brush bristles.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An aerosol shaving cream and razor implement, comprising, in combination, a safety razor, a brush, and a main body member receiving a replaceable container of shaving cream; said brush comprising a plurality of brush bristles set in a brush holder extending from the main body member, a hole through said brush holder providing communication between the shaving cream container and said brush bristles for passage of shaving cream therethrough; and a razor unit pivotally mounted on said main body member, said razor unit comprising a U-shaped yoke, opposite ends of said yoke being pivotally attached to diametrically opposite sides of main body member for extending the yoke over the brush bristles, means for locking the yoke in its extended position, and wherein said safety razor is supported from the mid portion of the yoke to project outwardly therefrom.

2. The combination as set forth in claim 1, and further comprising means defining an upwardly extending channel portion in the bottom of said main body member including a pair of diametrically opposed upwardly projecting notches from a bottom of said body member, said opposite ends of said yoke having elongated slots receiving projecting protrusions at the upper end of said main body member, whereby the yoke can be swung downwardly so that the safety razor projects from the bottom of the body portion and then pushed upwardly so that the mid portion on the yoke is received within the notches for storage.

3. The combination as set forth in claim 1, wherein said container of shaving cream comprises an aerosol can.

* * * * *